US006390939B1

(12) United States Patent
Palacios

(10) Patent No.: US 6,390,939 B1
(45) Date of Patent: May 21, 2002

(54) BATTING PRACTICE DEVICE

(76) Inventor: Jose A. Palacios, 117 N. County Rd. 1060, Kingsville, TX (US) 78363

( * ) Notice: Subject to any disclaimer, the term of this patent is extended or adjusted under 35 U.S.C. 154(b) by 0 days.

(21) Appl. No.: 09/675,135

(22) Filed: Sep. 29, 2000

(51) Int. Cl.[7] ..... A63B 69/00
(52) U.S. Cl. ..... 473/422; 473/451
(58) Field of Search ..... 473/417, 422, 473/427, 429, 430, 451, 453, 461, 423, 426, 428, 139, 138; D21/722, 780; 273/317.8, 317.6, 331, 334, 335

(56) References Cited

U.S. PATENT DOCUMENTS

| | | | | | |
|---|---|---|---|---|---|
| 1,399,293 | A | * | 12/1921 | Craig et al. | 473/147 |
| 3,271,030 | A | * | 9/1966 | Mueller | 473/423 |
| 3,408,070 | A | * | 10/1968 | Gonzales et al. | 473/427 |
| 3,547,437 | A | * | 12/1970 | Anderson | 473/427 |
| 3,663,018 | A | * | 5/1972 | O'Leary | 473/149 |
| 3,940,131 | A | * | 2/1976 | St. Claire, Jr. | 473/417 |
| 4,050,694 | A | * | 9/1977 | Domroski | 473/429 |
| 4,460,172 | A | * | 7/1984 | Hogan | 473/426 |
| 4,477,083 | A | * | 10/1984 | Sowards | 473/423 |
| 4,508,339 | A | | 4/1985 | Llewellyn | |
| 4,555,110 | A | | 11/1985 | Hai-Ping | |
| 4,907,801 | A | * | 3/1990 | Kopp | 473/423 |
| 5,184,816 | A | * | 2/1993 | Lunsford | 473/427 |
| 5,273,277 | A | * | 12/1993 | Freese | 473/429 |
| 5,303,914 | A | * | 4/1994 | Cooksey | 473/429 |
| 5,467,979 | A | * | 11/1995 | Zarate | 473/429 |
| 5,472,186 | A | * | 12/1995 | Paulsen | 473/429 |
| 5,553,848 | A | * | 9/1996 | Amron | 473/453 |
| 5,601,286 | A | * | 2/1997 | Fierbaugh | 473/429 |
| 5,618,039 | A | * | 4/1997 | Tsai et al. | 473/423 |
| D393,029 | S | | 3/1998 | Koo et al. | |
| 5,788,589 | A | | 8/1998 | Koo et al. | |
| 5,795,251 | A | * | 8/1998 | Anderson | 473/427 |
| 6,296,582 | B1 | * | 10/2001 | Minniear | 473/428 |

* cited by examiner

*Primary Examiner*—Paul T. Sewell
*Assistant Examiner*—Alvin A. Hunter, Jr.

(57) ABSTRACT

A batting practice device for training a user to hit a ball. The batting practice device includes a stabilizing member, a connecting bar, a vertical post, a upper vertical member, a rotating arm and a ball. The stabilizing member is used for providing ballast for the batting practice device. The connecting bar couples the stabilizing member to the vertical post portion. In addition, the upper vertical member is rotatably coupled to the vertical post portion. The rotating arm has a first end and a second end. The first end of the rotating arm is coupled to the upper vertical member. The ball is coupled to the second end of the rotating arm. Thus a force asserted on the ball rotates the ball and rotating arm around the vertical post portion.

11 Claims, 4 Drawing Sheets

BATTING PRACTICE DEVICE

BACKGROUND OF THE INVENTION

1. Field of the Invention

The present invention relates to training devices and more particularly pertains to a new batting practice device for training a user to hit a ball.

2. Description of the Prior Art

The use of training devices is known in the prior art. More specifically, training devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,555,110; 5,601,286; 5,788,589; 5,472,186; 4,508,339; and U.S. Pat. No. Des. 393,029.

While these devices fulfill their respective, particular objectives and requirements, the aforementioned patents do not disclose a new batting practice device. The inventive device includes a stabilizing member, a connecting bar, a vertical post, a upper vertical member, a rotating arm and a ball. The stabilizing member is used for providing ballast for the batting practice device. The connecting bar couples the stabilizing member to the vertical post portion. In addition, the upper vertical member is rotatably coupled to the vertical post portion. The rotating arm has a first end and a second end. The first end of the rotating arm is coupled to the upper vertical member. The ball is coupled to the second end of the rotating arm. Thus a force asserted on the ball rotates the ball and rotating arm around the vertical post portion.

In these respects, the batting practice device according to the present invention substantially departs from the conventional concepts and designs of the prior art, and in so doing provides an apparatus primarily developed for the purpose of training a user to hit a ball.

SUMMARY OF THE INVENTION

In view of the foregoing disadvantages inherent in the known types of training devices now present in the prior art, the present invention provides a new batting practice device construction wherein the same can be utilized for training a user to hit a ball.

The general purpose of the present invention, which will be described subsequently in greater detail, is to provide a new batting practice device apparatus and method which has many of the advantages of the training devices mentioned heretofore and many novel features that result in a new batting practice device which is not anticipated, rendered obvious, suggested, or even implied by any of the prior art training devices, either alone or in any combination thereof.

To attain this, the present invention generally comprises a stabilizing member, a connecting bar, a vertical post, a upper vertical member, a rotating arm and a ball. The stabilizing member is used for providing ballast for the batting practice device. The connecting bar couples the stabilizing member to the vertical post portion. In addition, the upper vertical member is rotatably coupled to the vertical post portion. The rotating arm has a first end and a second end. The first end of the rotating arm is coupled to the upper vertical member. The ball is coupled to the second end of the rotating arm. Thus a force asserted on the ball rotates the ball and rotating arm around the vertical post portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new batting practice device apparatus and method which has many of the advantages of the training devices mentioned heretofore and many novel features that result in a new batting practice device which is not anticipated, rendered obvious, suggested, or even implied by any of the prior art training devices, either alone or in any combination thereof.

It is another object of the present invention to provide a new batting practice device that may be easily and efficiently manufactured and marketed.

It is a further object of the present invention to provide a new batting practice device that is of a durable and reliable construction.

An even further object of the present invention is to provide a new batting practice device which is susceptible of a low cost of manufacture with regard to both materials and labor, and which accordingly is then susceptible of low prices of sale to the consuming public, thereby making such batting practice device economically available to the buying public.

Still yet another object of the present invention is to provide a new batting practice device which provides in the apparatuses and methods of the prior art some of the advantages thereof, while simultaneously overcoming some of the disadvantages normally associated therewith.

Still another object of the present invention is to provide a new batting practice device for training a user to hit a ball.

Yet another object of the present invention is to provide a new batting practice device which includes a stabilizing member, a connecting bar, a vertical post, a upper vertical member, a rotating arm and a ball. The stabilizing member is used for providing ballast for the batting practice device. The connecting bar couples the stabilizing member to the vertical post portion. In addition, the upper vertical member is rotatably coupled to the vertical post portion. The rotating arm has a first end and a second end. The first end of the rotating arm is coupled to the upper vertical member. The ball is coupled to the second end of the rotating arm. Thus a force asserted on the ball rotates the ball and rotating arm around the vertical post portion.

Still yet another object of the present invention is to provide a new batting practice device that is easy to set up.

Even still another object of the present invention is to provide a new batting practice device that improves hand/eye coordination and timing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
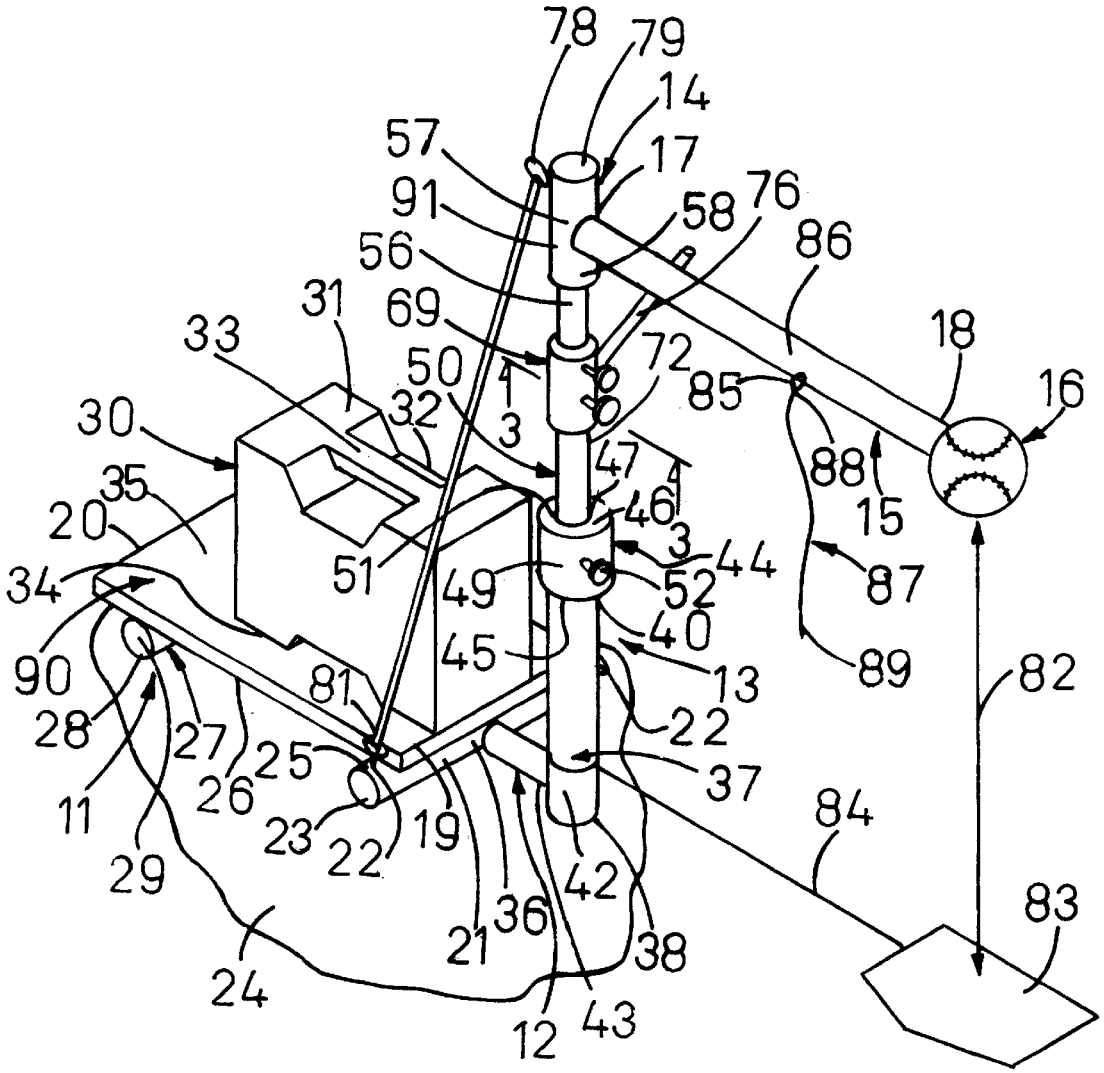
FIG. 1 is a schematic perspective view of a new batting practice device according to the present invention.
Figure 2:
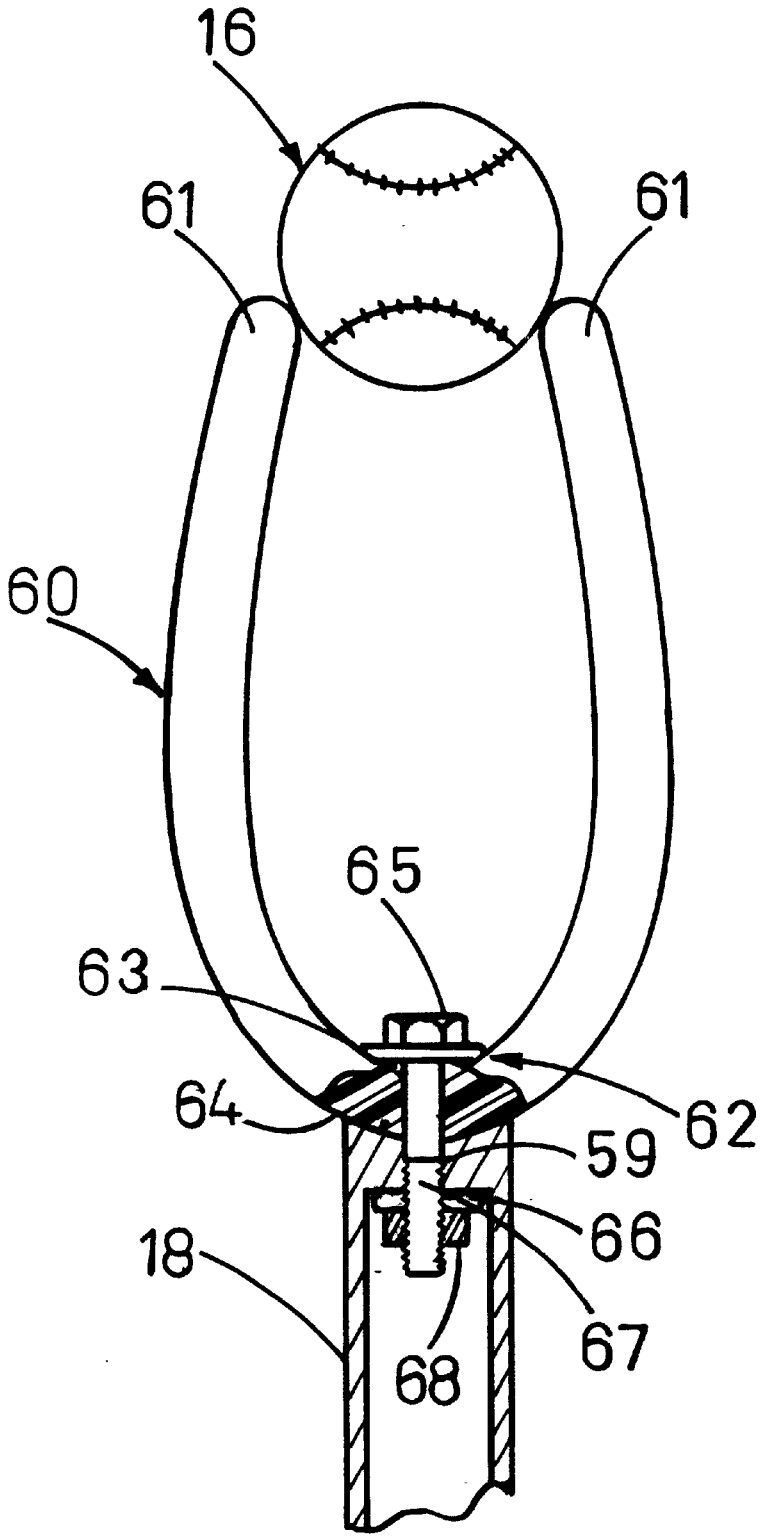
FIG. 2 is a schematic side view of the ball holding member of the present invention.
Figure 5:
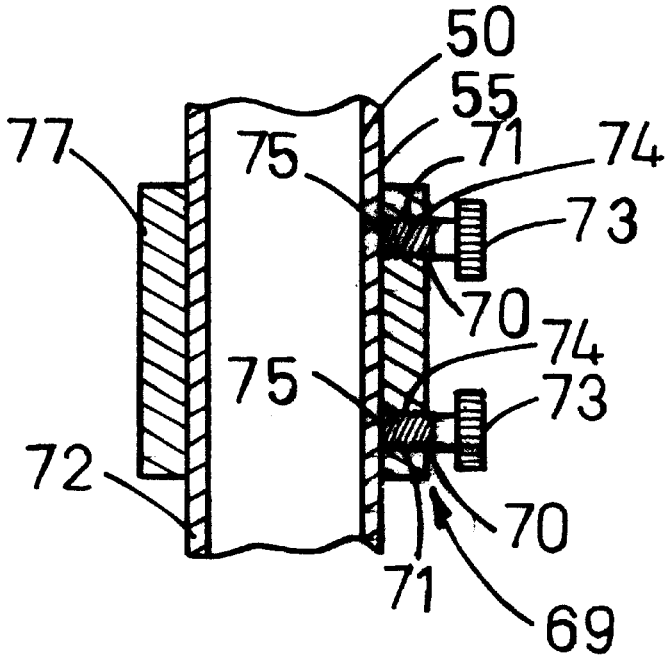
FIG. 5 is a schematic side view of the second collar of the present invention.
Figure 3:
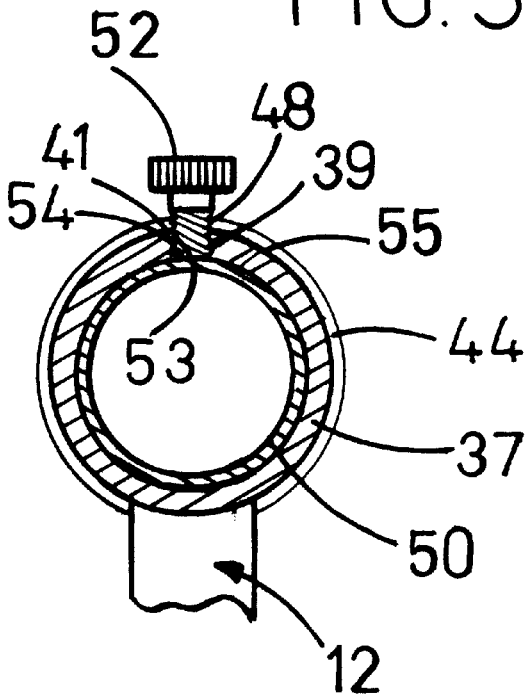
FIG. 3 is a schematic cross-sectional top view of the first collar of the present invention.
Figure 4:
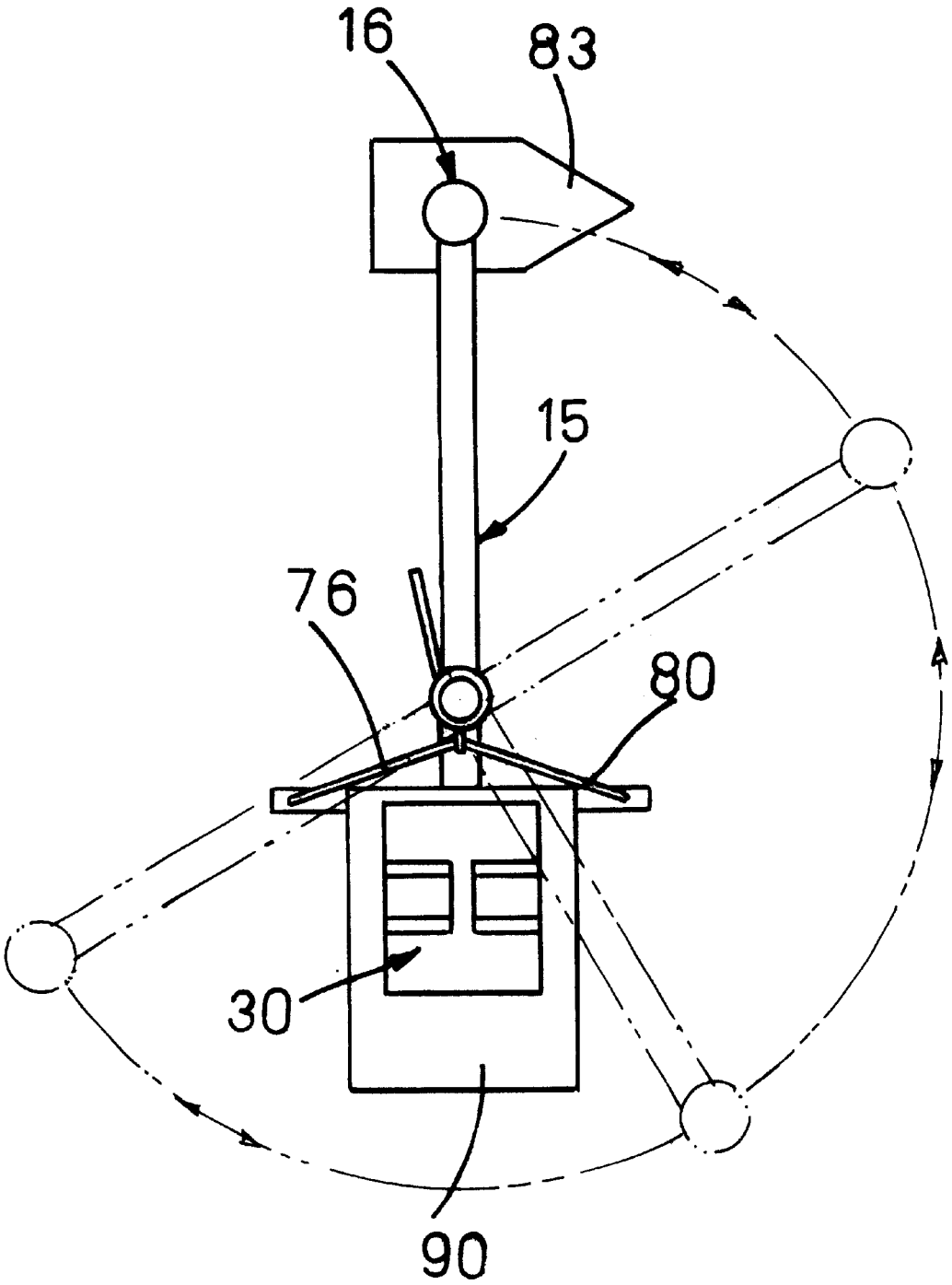
FIG. 4 is a schematic top view of the present invention.

With reference now to the drawings, and in particular to FIGS. 1 through 5 thereof, a new batting practice device embodying the principles and concepts of the present invention and generally designated by the reference numeral 10 will be described.

As best illustrated in FIGS. 1 through 6, the batting practice device 10 generally comprises a stabilizing member 11, a connecting bar 12, a vertical post portion 13, an upper vertical member 14, a rotating arm 15 and a ball 16. The stabilizing member 11 is used for providing ballast for the batting practice device 10. The connecting bar 12 couples the stabilizing member 11 to the vertical post portion 13. In addition, the upper vertical member 14 is rotatably coupled to the vertical post portion 13. The rotating arm 15 has a first end 17 and a second end 18. The first end 17 of the rotating arm 15 is coupled to the upper vertical member 14. The ball 16 is coupled to the second end 18 of the rotating arm 15. Thus a force asserted on the ball 16 rotates the ball 16 and the rotating arm 15 around the vertical post portion 13.

In closer detail, the stabilizing member 11 includes a generally rectangular base plate 90. The base plate 90 has a length that is defined between a first end 19 of the base plate 90 and a second end 20 of the base plate 90.

A generally cylindrical first support bar 21 is used for supporting the base plate 90. The first support bar 21 has a length that is longer than a width of the base plate 90. Moreover, the length of the first support bar 21 is defined between a pair of outside ends 22 of the first support bar 21. The first support bar 21 has a first lower surface 23. The first lower surface 23 is designed to abut a support surface 24 upon which the first support bar 21 is placed. The first support bar 21 further has a first upper surface 25. The first upper surface 25 of the first support bar 21 is coupled to a bottom surface 26 of the base plate 90 proximate the first end of the base plate 90. The outside ends 22 of the first support bar are further positioned to extend beyond the width of the base plate 90.

A generally cylindrical second support bar 27 is also used for supporting the base plate 90. The second support bar 27 has a length substantially equal to the width of the base plate 90. The second support bar 27 has a second lower surface 28. The second lower surface 28 is designed to abut a support surface 24 upon which the second support bar 27 is placed. The second support bar 27 further has a second upper surface 29. The second upper surface 29 of the second support bar 27 is coupled to the bottom surface 26 of the base plate 18 proximate the second end 20 of the base plate 18. The second support bar 27 is further positioned to extend the width of the base plate 90.

A generally rectangular box shaped ballast member 30 is used for holding the base plate 90 in a static position. The ballast member 30 is designed to hold a quantity of liquid. The ballast member 30 further has a top surface 31. The top surface 31 has a top cut out portion 32 that is designed to form a handle 33 that is used for grasping. The ballast member 30 further has a bottom surface 34 that is designed to abut an upper surface 35 of the base plate 90. The bottom surface 34 of the ballast member 30 abuts the upper surface 35 of the base plate 90.

The connecting bar 12 is a generally cylindrical shape. The connecting bar 12 extends perpendicular from a medial portion 36 of the first support bar 26. Moreover, the connecting bar 12 is further positioned to extend away from the base plate 90.

The vertical post portion 13 includes a generally tubular first vertical member 37. The first vertical member 37 has a first end 38 that is designed to abut a support surface 24 upon which the first end 38 is placed. The first vertical member 37 also has a set screw aperture 39. The set screw aperture 39 is positioned proximate a second end 40 of the first vertical member 37. The set screw aperture 39 further has internal threads 41. An outside surface 42 of the first vertical member 37 is coupled perpendicular to a distal end 43 of the 12 connecting bar proximate the first end 38 of the first vertical member 37.

The vertical post portion 13 also includes a generally tubular first collar 44. The first collar 44 has a diameter slightly larger than a diameter of the first vertical member 37. The first collar 44 has an open first end 45 and a closed second end 46. The second end 46 of the first collar 44 further has a first aperture 47. The first aperture 47 has a diameter less than a diameter of the first vertical member 37. The first collar 44 further has a second aperture 48.

The second aperture 48 is position proximate a medial portion 49 of the first collar 44. The medial portion 49 of the first collar 44 is positioned between the first end 45 and the second end 46 of the first collar 44. The second end 40 of the first vertical member 37 is received in the open first end 45 of the first collar 44. Moreover, the second aperture 48 in the first collar 44 is designed to aligned with the set screw aperture 39 in the first vertical member 37 when the second end 40 of the first vertical member 37 is received in the open first end 45 of the first collar 44.

The vertical post portion 13 further includes a generally tubular second vertical member 50. The second vertical member 50 has a diameter slightly less than the diameter of the first aperture 47 in the second end 46 of said first collar 44. A first end 51 of the second vertical member 50 is received in the first aperture 47 in the first collar 44.

A first set screw 52 is used for adjusting an overall length of the vertical post portion 13. The first set screw 52 has external threads 53 adapted to engage the internal threads 41 in the set screw aperture 39 in the first vertical member 37. The first set screw 52 is received in the second aperture 48 in the first collar 44. The external threads 53 of the first set screw 52 are threadably engaged to the internal threads 41 in the set screw aperture 39. A distal end 54 of the first set screw 52 selectably abuts an outside surface 55 of the second vertical member 50. Thus, once the first end 51 of the second vertical member 50 is inserted in the first vertical member 37 a desired distance, the first set screw 52 is tightened thereby holding the second vertical member 50 in a static position relative to the first vertical member 50.

The upper vertical member 14 is generally cylindrical in shape. The upper vertical member 14 has a first end 91 that is rotatably coupled to a second end 56 of the second vertical member 50.

In addition, the rotating arm 15 is generally tubular in shape. The first end 17 of the rotating arm is coupled to a medial portion 57 of an outside surface 58 of the upper vertical member 14. Moreover, in an embodiment that is designed to hold different sized softballs and baseballs, the second end 18 of the rotating arm 15 is closed. The closed second end 18 of the rotating arm 15 has a connection aperture 59.

A generally U-shaped ball holding member 60 is used to hold the different sized softballs and baseballs. The ball holding member 60 has distal ends 61 designed to hold a ball 16 between the distal ends 61. Moreover, the ball holding member 60 has a medial portion 62 that is positioned in between said distal ends 61. The medial portion 62 of the ball holding member 60 has a holding aperture 63. The holding aperture 63 has a diameter substantially equal to a diameter of the connection aperture 59 in the second end 18 of the rotating arm 15.

The medial portion 62 of the ball holding member 60 has an outside surface 64 that is designed to abut the second end 18 of the rotating arm 15. The outside surface 64 of the medial portion 62 of the ball holding member 60 is positioned to abut the second end 18 of the rotating arm 15. Moreover, the holding aperture 63 of the ball holding member 60 is positioned to align with the connection aperture 59 in the second end 18 of the rotating arm 15.

A bolt 65 is used for coupling the ball holding member 60 to the second end 18 of the rotating arm 15. The bolt 65 has a diameter that is slightly less than the diameter of the connection aperture 59 of the rotating arm 15 and the diameter of the holding aperture 63 in the ball holding member 60. The bolt 65 is received in the connection aperture 59 of the rotating arm 15 and in the holding aperture 63 in the ball holding member 60.

A washer 66 is received around a distal portion 67 of the bolt 65. A nut 68 that is designed to threadably engage the distal portion 67 of the bolt 65. The nut 68 threadably engages the distal portion 67 of the bolt 65. Thus the nut 68 and the bolt 65 couple the ball holding member 60 to the second end 18 of the rotating arm 15.

The batting practice device 10 includes a generally tubular second collar 69. The second collar 69 has a diameter slightly larger than the diameter of the second vertical member 50. The second collar 69 has a pair of second collar apertures 70. The second collar apertures 70 are positioned a predetermined distance apart from each other. Moreover, each second collar aperture 70 has internal threads 71. The second collar 69 is received around a medial portion 72 of the second vertical member 50. The medial portion 72 of the second collar 69 is positioned between the first end 51 and the second end 56 of the second vertical member 50.

A pair of second collar set screws 73 are used to selectably couple the second collar 69 to the second vertical member 50. Each second collar set screw 73 has external threads 74 that are designed to engage the internal threads 71 of an associated second collar aperture 70. Each second collar set screw 73 has a distal end 75 that is designed to abut the outside surface 55 of the second vertical member 50. The external threads 74 of each second collar set screw 73 is threadably engaged to the internal threads 71 of an associated second collar aperture 70. Thus the distal end 75 of each second collar set screw selectably 73 abuts the outside surface 55 of the second vertical member 50 thereby holding the second collar 69 in a static position relative to the second vertical member 50.

An elongated stop rod 76 is used for stopping the rotating arm 15 from rotating in a complete circle. The stop rod 76 extends from an outside surface 77 of the second collar 69. The stop rod 76 further extends at a predetermined angle relative to the second collar 69. Thus the stop rod 76 comes into contact with the rotating arm 15 as the rotating arm 15 rotates about the vertical post portion 13 thereby stopping the rotating arm 15 at a predetermined position.

The batting practice device 10 also includes a home plate 83. Moreover, the ball 16 has a hitting position 82. The hitting position 82 is defined when the ball 16 is positioned directly over the home plate 83. A connecting cord 84 is used for coupling the home plate 83 to the first vertical member 37. The connecting cord 84 has a predetermined length. Thus when the connecting cord 84 is fully extended away from the first vertical member 37 the ball 16 is positioned in the hitting position 82.

The batting practice device 10 also has a first ring portion 78. The first ring portion 78 is coupled to the outside surface 58 of the upper vertical member 14 proximate a top end 79 of the upper vertical member 14. The first ring portion 78 is further coupled to a portion of the outside surface 58 that is directly opposite a portion of the outside surface 58 upon which the rotating arm 15 extends from. The first ring portion 78 further has a center axis that is positioned generally perpendicular to a longitudinal axis of the upper vertical member 14.

An elastic cord 80 extends through the first ring portion 78. The elastic cord 80 has distal ends 81. Each distal end 81 of the elastic cord 80 is coupled to an associated outside end 22 of the first support bar 21. Thus the elastic cord 80 urges the rotating arm 15 to the hitting position 82 when the rotating arm 15 is rotated.

The batting practice device 10 further includes a second ring portion 85. The second ring portion 85 is coupled to a medial portion 86 of the rotating arm 15. The medial portion of the rotating arm 15 is positioned between the first end 17 and second end 18 of the rotating arm 15.

In addition the batting practice device 10 includes a pull cord 87. The pull cord 87 has a first end 88. The first end 88 of the pull cord 87 is coupled to the second ring portion 85. The pull cord 87 further has a second end 89. The second end 89 of the pull cord 87 is designed to be pulled. Thus the rotating arm 15 maybe manually pulled away from the hitting position 82 by the pull cord 87 and released to simulate a pitch thrown by a pitcher.

In use, the first set screw 52 in the first collar 44 is manipulated to set the overall height of the vertical post portion 13. The base plate 83 is then positioned under the ball 16. The user may then practice hitting the stationary ball 16. When the ball is hit, the ball 16 and the rotating arm 15 will rotate about the vertical post portion 13 until the rotating arm 15 comes into contact with the stop rod 76. The elastic cord 80 then automatically forces the ball 16 back to the hitting position 82.

If the user wants to simulate a pitched ball, the pull cord 87 is attached to the second ring portion 85. A second person then grasps the second end 89 of the pull cord 87 and pulls the ball 16 and rotating arm 15 away from the hitting position 82. When the user is ready, the second person releases the pull cord 87. The elastic cord 80 then rotates the ball 16 and the rotating arm 15 into the hitting position 82 thereby simulating a pitch thrown by a pitcher.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A batting practice device comprising:

a stabilizing assembly for resting on a ground surface to provide ballast;

a post assembly mounted on said stabilizing assembly for orienting in a substantially vertical orientation, said stabilizing assembly extending away from said post assembly in a longitudinal direction;

a rotating arm assembly having a rotating arm with a first end and a second end, said first end of said rotating arm being rotatably mounted on said vertical post assembly; and a biasing assembly for biasing said rotating arm into a centered position in which said rotating arm assembly extends from said post assembly in an opposite longitudinal direction from said stabilizing assembly, said biasing assembly including a pair of tension members extending from said rotating arm assembly to said stabilizing assembly, first ends of said tension members being mounted on said stabilizing assembly at laterally spaced locations and second ends of said tension members being mounted on said rotating arm assembly such that rotation of said rotating arm assembly from said centered position increases tension in said tension members and said increase in tension tends to rotate said rotating arm assembly toward said centered position;

a pull cord having a first end mounted on said rotating arm between said first and second ends of said rotating arm such that pulling on said second end of said pull cord moves said rotating arm out of said centered position and increases tension in said tension members so that release of said pull cord causes said rotating arm toward said centered position to simulate movement of a pitched ball by a ball mounted on said rotating arm.

2. The batting practice device of claim 1 wherein said stabilizing assembly further comprises:

a ballast member for permitting selective adjustment of a total weight of said stabilizing assembly, said ballast member having an interior adapted to receive liquid to permit variance of a weight of said ballast member by selectively adding to or removing from a quantity of liquid in said interior.

3. The batting practice device of claim 1 wherein said stabilizing assembly further comprises:

a base plate with an upper surface;

wherein said ballast member has a bottom for resting on the upper surface of said base plate; and wherein said ballast member has a top with a handle integrally formed therein for permitting lifting of said ballast member off of said base plate.

4. The batting practice device of claim 1 further comprising:

a home plate;

a connecting cord coupling said home plate to said post assembly, said connecting cord having a predetermined length such that when said connecting cord is fully extended away from said post assembly said home plate is positionable below a ball when the ball is mounted on the first end of said rotating arm.

5. A batting practice device comprising:

a stabilizing assembly for resting on a ground surface to provide ballast;

a post assembly mounted on said stabilizing assembly for orienting in a substantially vertical orientation, said stabilizing assembly extending away from said post assembly in a longitudinal direction;

a rotating arm assembly having a rotating arm with a first end and a second end, said first end of said rotating arm being rotatably mounted on said vertical post assembly; and a biasing assembly for biasing said rotating arm into a centered position in which said rotating arm assembly extends from said post assembly in an opposite longitudinal direction from said stabilizing assembly, said biasing assembly including a pair of tension members extending from said rotating arm assembly to said stabilizing assembly, first ends of said tension members being mounted on said stabilizing assembly at laterally spaced locations and second ends of said tension members being mounted on said rotating arm assembly such that rotation of said rotating arm assembly from said centered position increases tension in said tension members and said increase in tension tends to rotate said rotating arm assembly toward said centered position;

wherein said post assembly further comprises:

a lower first vertical member having a first end and a second end;

an upper second vertical member having a first end positioned adjacent to the second end of said first vertical member, said first and second vertical members being substantially axially aligned; and a first collar for connecting said first vertical member and said second vertical member, said first collar receiving the second end of said first vertical member and the first end of said second vertical member;

a second collar having a lumen receiving an intermediate section of said post assembly;

an elongated stop rod for stopping rotation of the rotating arm at a predetermined position, said stop rod being mounted on said second collar and extending generally outwardly and upwardly from said second collar.

6. The batting practice device of claim 5 additionally comprising means for selectively setting a rotational position of said second collar with respect to said post assembly for adjustably fixing a rotational position of said stop rod with respect to said rotational arm.

7. The batting practice device of claim 1 wherein said rotating arm assembly comprises:

a substantially U-shaped ball holding member mounted on said rotating arm for removably holding a ball, said ball holding member having a pair of fingers extending in a generally parallel orientation from the second end of said rotating arm for holding a ball between said pair of fingers.

8. The batting practice device of claim 1 wherein said rotating arm assembly further comprises:

a sleeve mounted on the second end of said rotating arm and receiving an upper section of said post assembly such that said sleeve is rotatable about said post assembly, said rotating arm extending in a radially outward direction from said sleeve;

a ring mounted on said sleeve at a distance from a center of rotation of said rotating arm assembly.

9. The batting practice device of claim 8 wherein each of said tension members comprises an elastic cord mounted on said ring and said stabilizing assembly.

10. The batting practice device of claim 1 additionally comprising a connecting bar mounting said vertical post assembly on said stabilizing assembly.

11. The batting practice device of claim 1 wherein said stabilizing assembly further comprises:

a base plate; and support means for supporting said base plate in an elevated condition above a ground surface.

* * * * *